US005860848A

United States Patent [19]

Loncki et al.

[11] Patent Number: 5,860,848

[45] Date of Patent: Jan. 19, 1999

[54] POLISHING SILICON WAFERS WITH IMPROVED POLISHING SLURRIES

[75] Inventors: Scott B. Loncki, Lincoln University; Lee Melbourne Cook, Steelville, both of Pa.; James Shen, Bear; Keith G. Pierce, Newark, both of Del.

[73] Assignee: Rodel, Inc., Newark, Del.

[21] Appl. No.: 758,064

[22] Filed: Nov. 27, 1996

Related U.S. Application Data

[63] Continuation-in-part of Ser. No. 458,036, Jun. 1, 1995, abandoned.

[51] Int. Cl.[6] ..... B24B 1/04

[52] U.S. Cl. ..... 451/36; 451/41; 451/63; 451/285; 451/286; 451/287; 451/288; 451/289

[58] Field of Search ..... 451/41, 63, 285–289; 57/298

[56] References Cited

U.S. PATENT DOCUMENTS

| | | | |
|---|---|---|---|
| 3,170,273 | 2/1965 | Walsh et al. | 51/281 |
| 3,429,080 | 2/1969 | Lachapelle | 51/308 |
| 3,715,842 | 2/1973 | Tredinnick et al. | 51/281 |
| 3,807,979 | 4/1974 | Cromwell | 51/308 |
| 4,057,939 | 11/1977 | Basi | 51/281 R |
| 4,169,337 | 10/1979 | Payne | 51/283 R |
| 4,274,599 | 6/1981 | Manfroy et al. | 51/298 |
| 4,462,188 | 7/1984 | Payne | 51/283 R |
| 4,468,381 | 8/1984 | Prigge et al. | 156/489 |
| 4,549,374 | 10/1985 | Basi et al. | 451/41 |
| 4,892,612 | 1/1990 | Huff | 156/636 |
| 5,226,930 | 7/1993 | Sasaki | 51/308 |
| 5,307,593 | 5/1994 | Lucker et al. | 451/63 |

OTHER PUBLICATIONS

Hahn, P.O. et al, "The Si–$SiO_2$ Interface Roughness: Causes and Effects", The Physics & Chemistry of $SiO_2$ and the Si–$SiO_2$ Interface, pp. 401–411, Plenum Press, N.Y. 1988.

*Primary Examiner*—Robert A. Rose
*Assistant Examiner*—George Nguyen
*Attorney, Agent, or Firm*—Kenneth A. Benson

[57] ABSTRACT

An improved slurry composition and methods of using it are provided for final polishing of silicon wafers. The composition comprises water, submicron silica particles at about 0.02 to about 0.5 percent by weight of this composition, a salt at a concentration of about 100 to about 1000 ppm, an amine compound at a concentration sufficient to effect a composition pH of about 8 to about 11, and a polyelectrolyte dispersion agent at a concentration of about 20 to about 500 ppm, wherein the composition has a total sodium and potassium content below about 1 ppm and an iron, nickel and copper content each below about 0.1 ppm, all ppm being parts per million by weight of the composition.

27 Claims, No Drawings

POLISHING SILICON WAFERS WITH IMPROVED POLISHING SLURRIES

This application is a continuation-in-part of application Ser. No. 08/458,036, filed Jun. 1, 1995, now abandoned.

BACKGROUND OF THE INVENTION

1. Technical Field

The present invention relates to compositions which are used as polishing slurries in the process of polishing silicon wafers for the semiconductor industry.

2. Background Art

Silicon wafers for the semiconductor industry must possess a high degree of surface perfection before they can be useful in the device fabrication process. These surfaces are universally produced by polishing the wafer with a polishing slurry. Polishing slurries generally consist of a composition which contains a concentration of submicron particles. The part, or substrate, is bathed or rinsed in the slurry in conjunction with an elastomeric pad which is pressed against the substrate and rotated such that the slurry particles are pressed against the substrate under load. The lateral motion of the pad causes the slurry particles to move across the substrate surface, resulting in wear, or volumetric removal of the substrate surface. Ideally, this process results in the selective erosion of projecting surface features so that when the process is completed a perfect plane surface is produced down to the finest level of detail.

The silicon polishing process as practiced in industry consists of two or more steps. In the first, or coarse polish step, gross defects remaining from wafer sawing and shaping operations are removed. The wafer surface appears smooth and specular but still contains numerous minute defects. These defects are removed by subsequent final polish steps which remove little material from the surface but act to polish away the surface defects. which remove little material from the surface but act to polish away the surface defects. The present invention relates to solutions which are particularly useful for this final polish process.

The number and allowable size of surface imperfections remaining after polishing has been continuously decreasing with time for many years. Some of the most critical material specifications are the surface metals content, the front surface microroughness and the total particles per unit area.

The metal ion concentration on a wafer surface may be determined by several conventional means of chemical analysis. The most popular non-destructive technique used in the semiconductor industry is X-Ray Fluorescence (XRF). While there are many possible means of introducing metal ions into the wafer surface, it is generally agreed that materials and solutions which come in contact with the wafer surface should have the lowest possible metal ion contents to prevent possible contamination.

The measurement of surface roughness and surface defect/particle concentrations on polished wafers is generally performed by a scanning light scattering detector. Various models; e.g. Censor ANS100, Tencor 6200 and Estek WIS9000; are widely used in the silicon wafer industry. All detectors utilize the same principle of operation, namely that they measure the degree of non-specular reflected light from the wafer surface. A high intensity laser beam is scanned across the surface of the wafer. Non-specular reflected light is collected in an off-axis detector and the signal intensity of this scattered light is analyzed. Surface roughness results in a generalized light scattering of low intensity, generally termed haze. Particles or other discrete surface imperfections produce a more intense scattering which has a point source origin. The intensity of these point sources of scattering is ranked in comparison to that of latex standard calibration spheres of varying sizes. These point sources are generally referred to as Light Point Defects, or LPDs and their distribution is ranked according to Equivalent Latex Sphere sizes which give equivalent scattering intensity. A good general review of wafer measurement technology and terminology is given by P. O. Hahn et al. in an article entitled "The Si—$SiO_2$ Interface Roughness: Causes and Effects" in C. R. Helms and B. E. Dead, Eds., *The Physics and Chemistry of SiO2 and the Si—SiO2 Interface*, pp.401–411, Plenum Press, New York (1988) incorporated by reference herein.

From the above, it is clear that a practically useful final polish process for achieving high surface quality levels must be one which does not introduce surface metals onto the substrate surface and produces a low roughness surface free from particles or other sources of light scattering on the wafer surface. It is generally observed that existing prior art final polishing slurries cannot achieve the desired results; existing slurries are either insufficiently pure or do not readily allow haze or LPD targets to be met.

There are numerous background patents on slurries to be used for polishing silicon wafers. The following are considered relevant to the present invention.

Walsh and Herzog (U.S. Pat. No. 3,170,273) describe polishing slurries for silicon wafers consisting of a silica sol having a size between 5–200 nm in a concentration ranging from 2–50% by weight. No criticality of pH, freedom from metal ion contaminants or other additives was taught.

LaChapelle (U.S. Pat. No. 3,429,080) described a polishing slurry for silicon wafers consisting of a dispersion of abrasive particles of a size below 20 microns and an oxidant, wherein the slurry pH ranged from 4.5 to 14. No criticality of pH, solids concentration, freedom from metal ion contaminants or other additives was taught.

Cromwell (U.S. Pat. No. 3,807,979) described a polishing slurry for silicon wafers comprising a quaternary ammonium silicate and precipitated silica. Nothing was taught as to the criticality of solids content, pH, freedom from metal ion contaminants or other solution additives.

Tredinninck et al (U.S. Pat. No. 3,715,842) described a polishing slurry for silicon wafers comprising an abrasive in a slurry concentration ranging from 5–80% solids and a water soluble cellulose compound. Nothing was taught as to the criticality of solids content within this exceedingly large range, pH, freedom from metal ion contaminants or other solution additives.

Basi et al (U.S. Pat. No. 4,057,939) described a polishing slurry for silicon wafers comprising silica particles, sodium carbonate (as a base), an oxidizing agent, and sodium dichloroisocyanurate. Nothing was taught as to the criticality of solids content, pH, freedom from metal ion contaminants or other solution additives.

Payne1 (U.S. Pat. No. 4,169,337) described a polishing slurry for silicon wafers comprising $SiO_2$ particles and an amine having a concentration of 0.1–5% based on $SiO_2$ content. A wide variety of amines were disclosed including aminoethanolamine. No limits on $SiO_2$ concentration were taught and the amine was incorporated in concentration ranges far in excess of what would be required for pH adjustment. Nothing was taught as to the criticality of solids content, pH, freedom from metal ion contaminants or other solution additives.

Payne2 (U.S. Pat. No. 4,462,188) described a polishing solution for silicon wafers comprising silica particles, a water soluble amine in concentration between 0.5–5% and a quaternary ammonium salt or hydroxide. A variety of amines were disclosed, including aminoethanolamine. The preferred ammonium salt or hydroxide disclosed was tetramethyl ammonium chloride or hydroxide. Nothing was taught as to the criticality of solids content, pH, freedom from metal ion contaminants or other solution additives.

Prigge et al (U.S. Pat. No. 4,468,381) described a polishing slurry for silicon wafers comprising solid particles of a concentration between 1–10%, a buffer compound to control pH, an alcohol (preferably glycerols), a polar organic (preferably glycols) and a surface active substance which could include alkyl phenols, alkyl sulfonates, alkyl succinates or polyacrylates. The pH range of activity was restricted to 3–7. Nothing was taught as to the criticality of solids concentrations beyond the wide range described, the incorporation of other salts or the freedom from metal ion contaminants.

Huff (U.S. Pat. No. 4,892,612) teaches the utility of using a silica sol-amine combination in specific proportions to provide high polishing rates at low as-used solids concentration for stock polishing. A lower effective solids limit for the sol-amine combination was ~1%; a solids content of 0.5% as-used gave degraded results. Nothing was taught as to the incorporation of other salts or other solution additives. In addition, the materials described were utilized in a stock polish process. Nothing was taught as to their potential utility as a final polish slurry.

Sasaki et al (U.S. Pat. No. 5,226,930) described a polishing slurry comprising a dispersion of $SiO_2$ particles at a concentration between 0.1–10% by weight and with a solution pH ranging from 8–12 which was adjusted by the incorporation of an amine or ammonium hydroxide.

None of the prior art cited or found teaches the criticality of providing a polishing slurry free from metal ions nor do they teach specific compositions which are suitable for a final polishing process which produces a polished silicon surface free from haze or point scattering defects. Indeed almost all of the prior art is exceedingly vague as to the use to which their slurries described may be put and there results obtained therefrom. Of the art examined, only Prigge et al and Payne2 teach the use of their slurries in a final polishing step. Payne2 does not teach the recognition of any special compositional requirements for a final polish slurry; the same slurry formulation is used in both stock and final steps for all examples disclosed.

From the above, it is clear that it would be highly desirable to provide a final polishing slurry free from metal contaminants which was specifically designed to produce surfaces having desirably low haze and point scattering defect levels.

SUMMARY OF THE INVENTION

The deficiencies of the prior art are overcome by providing an aqueous composition useful as a slurry for the final polishing of silicon wafers, having a low content of alkali metals and certain transition metals. The composition comprises water, submicron silica particles at about 0.02 to about 0.5 percent by weight of the composition, a salt at a concentration of about 100 to about 1000 ppm, an amine compound at a concentration sufficient to effect a composition pH of about 8 to about 11, and a polyelectrolyte dispersion agent at a concentration of about 20 to about 500 ppm, wherein the composition has a total sodium and potassium content below about 1 ppm, and an iron, nickel, and copper content each below about 0.1 ppm, all ppm being parts per million by weight of the composition. A polishing slurry meeting these compositional limitations has the surprising ability to produce a surface nearly free from haze and point scattering defects in a consistent manner. The key elements and essential features of the invention are set forth below together with illustrative examples.

DETAILED DESCRIPTION OF THE INVENTION

The key feature of the present invention is to provide a specific set of chemical ingredients in combination together with a specific and very low concentration of solid particles. As will be shown in the examples below, the various components used separately or in combination with the other constituents in concentrations outside the specified ranges are substantially less effective in achieving the desired results. The basic effects and reasons for limits on incorporation of the various components is shown below.

One of the surprising features of slurries of the present invention is their ability to provide a defect-free polished surface at extremely low particle concentrations. Typical final polish slurries, e.g. Rodel LS-10, are supplied at a solids content of 13% and diluted 15:1 prior to use. This yields an as-used solids concentration of 0.87%. In contrast, slurries of the present invention have given superior results at significantly lower solids concentrations. The upper practical boundary of $SiO_2$ particle concentration is imposed by both cost, performance and the resulting alkali metal ion concentration in the as-used composition. At $SiO_2$ particle concentrations above 0.5% by weight no improvements in post polish surface quality are observed. At $SiO_2$ particle concentrations above 1–2% degraded surface quality is observed. The lower boundary of solids ($SiO_2$) concentration is set by performance limitations. At zero solids concentration no useful performance is observed. It has been surprisingly found that effective polishing performance can be obtained at extremely low particle solids concentrations of about 0.05% by weight. Thus the slurries of this invention are useful for polishing over a very large range of silica concentrations from about 0.02% to about 0.5% by weight.

Another surprising feature of slurries of the present invention is the effect of the addition of small amounts of salts on the quality of the polished silicon surface. While the precise basis of the salt effect is not fully understood, its effect is to significantly reduce the concentration of light point defects when used in combination with an amine. Salt concentrations below about 100 ppm in the slurry as used do not appear to have a significant beneficial effect. Salt concentrations above about 1000 ppm in the slurry as used also do not appear to have a beneficial effect. A practical upper limitation to the salt content is its concentration in the slurry concentrate prior to dilution. For example, a salt concentration of 5000 ppm when used at 20:1 dilution corresponds to a concentrate level of 10%. This may be above the solubility limit of the salt of interest, or it may result in coagulation of the slurry concentrate particles due to the well known salt effect. In practice the most important useful feature of the salt is that its cation have a low charge/radius ratio and that is not selected from the first row of the periodic table or from any of the transition metal elements known to be deleterious to Si wafers, particularly $Fe^{3+}$, $Cu^{2+}$ and $Ni^{2+}$. The ammonium cation is preferred. Other useful cations include the heavier alkaline earth elements (i.e., Sr, and Ba) and the various quaternary ammonium and alkyl-substituted quaternary ammonium ions. The choice of anion used in the salt is less restrictive, being generally dictated by the aqueous solubility of the salt. Nitrate, acetate, citrate, and carbonate anions are preferred for this reason.

Slurries of the present invention utilize amines and amine compounds as a base for adjustment of pH. An unexpected aspect of the invention is the aforementioned positive interaction between the amine used and the salt used which together result in the reduction of surface defects. Use of ammonium hydroxide, either alone or in combination with the aforementioned salts, does not exhibit this effect. Other potential bases, such as sodium or potassium hydroxide, are excluded due to the aforementioned wafer purity requirements. A wide variety of amines and compounds containing amine groups are useful additives. These include primary amines, secondary amines, tertiary amines, quaternary amines, heterocyclic amines, and any mixtures thereof. Preferred amines are ethanolamine, aminoethanolamine, guanidine, and ethylenediamine. Concentrations of the amine used are those sufficient to adjust the pH of the as-used slurry to any desired pH within the pH range of about 8 to about 11. Adjustment of pH to levels below or above this range yields increased surface defect levels and haze. A preferred pH is about 9 to about 11, and a more preferred pH is 9.8 in the slurry as used. Amines are particularly useful in maintaining pH over a wide range of dilutions as taught by Huff.

The function of the dispersion agent in slurries of the present invention is to reduce the tendency of slurry particles to adhere to the wafer surface during post-polish cleaning and drying operations. The dispersion agents are specifically restricted to polyelectrolytes, as this class of dispersion agent has been shown to not interfere with the polishing process. Preferred dispersion agents are homopolymers of polyacrylamide, polyethylene oxide, polyacrylic acid (PAA) and polyvinyl alcohol (PVA), as well as copolymers of these materials in combination with other monomer groups such as styrene. Concentrations of dispersion agent in the slurry as used should be between 100 and 1000 ppm. Concentrations below the lower limit are ineffective in blocking particle retention on the polished surface. Concentrations of dispersion agent above the claimed range have no added effectiveness and are generally insoluble in the concentrate prior to dilution, produce undesirable coagulation effects or result in increased slurry viscosity.

While the ranges of the various solution components of the present invention are cited in the as-used condition, it is often more economically desirable to prepare the solution as a concentrate, which is then diluted prior to use. Slurries of the present invention may also be prepared as concentrates so that upon dilution the various components are reduced in concentration to the desired range for proper activity. Slurries of the present invention are especially useful for production as a concentrate because of their particular usefulness at very low $SiO_2$ content. This permits a significantly greater quantity of useful slurry to be prepared from a given volume of concentrate as compared to formulations found in the background art.

The utility of the combination of additives outlined in the invention is clearly shown in the following examples. These are not meant to be restrictive in any way. On examination of these together with the claims and detailed discussion, additional benefits and advantages may become apparent to those skilled in the art.

EXAMPLE 1

A slurry corresponding to a background art slurry, which contains a polyelectrolyte dispersion agent (PVA), but is free from both salt and amine was prepared for a polishing test. The slurry pH was adjusted to 10.5 with ammonium hydroxide only. The composition and resulting haze and defect density after polishing is listed in Table 1 and is labeled as slurry A. A slurry of the present invention, labeled slurry B, was prepared with identical $SiO_2$ content, PVA content and pH, but with salt and amine added. Both slurries were prepared as concentrates and diluted 20:1 with water prior to their use. Both slurries were used on a commercial polishing machine under identical conditions commonly employed for the final polishing of silicon wafers using identical polishing pads. Light point defects and haze were measured using a Censor ANS100 scanning light scattering detector. The improvement in post-polished defect density (light point defects) is clearly seen.

TABLE 1

| Slurry | A (prior art) | B (present invention) |
|---|---|---|
| $SiO_2$ content (as-used) | 0.45% | 0.45% |
| Amine content as used (aminoethanolamine) | 0 ppm | 500 ppm |
| Salt content as used (ammonium carbonate) | 0 ppm | 500 ppm |
| Dispersion agent content as used (PVA, ppm) | 150 ppm | 150 ppm |
| Light point defect density per 150 mm diam. wafer (0.12–0.8 micron size) | 344 | 55 |
| Haze (ppm) | 0.065 | 0.056 |

EXAMPLE 2

To further illustrate the ability of slurries of the present invention to produce defect-free surfaces at extremely low pH and to further illustrate the criticality of the combination of ingredients, three additional slurries were prepared at lower as-used $SiO_2$ concentrations. Compositions and results are shown on Table 2. Slurries C and D represent formulations outside of the areas claimed in the present invention, where either the amine or the salt has been omitted from the formulation. Slurry D represents a slurry of the present invention. Again, all slurries were prepared as concentrates and diluted 20:1 with water prior to use. All polishing conditions were identical to those used in the first example. Again, light point defects and haze were measured using a Censor ANS100 scanning light scattering detector and it is clear that post-polish defect densities are undesirably high when any of the components are omitted from the formulation. Desirably low defect levels are obtained only when the amine, the salt and the dispersion agent are simultaneously present in the formulation.

TABLE 2

| Slurry | C (prior art) | D (prior art) | E (present invention) |
|---|---|---|---|
| $SiO_2$ content (as-used) | 0.25% | 0.25% | 0.25% |
| Amine content as used (aminoethanolamine) | 0 ppm | 500 ppm | 500 ppm |
| Salt content as used (ammonium carbonate) | 500 ppm | 0 ppm | 500 ppm |
| Dispersion agent content as used (PVA, ppm) | 150 ppm | 150 ppm | 87 ppm |
| Light point defect density per 150 mm diam. wafer (0.1–0.3 micron size) | 380 | 187 | 83 |
| Haze (ppm) | 0.079 | 0.070 | 0.060 |

EXAMPLE 3

A slurry of the present invention with very low silica content was made up in concentrated form and diluted prior to use to give a slurry composition shown as slurry F on Table 3. For comparison, a slurry with even lower silica content and similar concentrations of other slurry components was used for polishing tests. The post-polish defect densities were undesirably high. For this example, LPDs and Haze were measured by SFS 6220 and, therefore, do not compare directly to the values for LPDs and Haze as shown in Examples 1 and 2. The results, however, are excellent showing the effectiveness of the invention at extremely low amounts of silica solids in the slurry composition.

TABLE 3

| Slurry | F (present invention) | G |
|---|---|---|
| $SiO_2$ content (as-used) | 0.058% | 0.007% |
| Amine content as used (aminoethanolamine) | >63 ppm | 63 ppm |
| Salt content as used (ammonium bicarbonate) | 313 ppm | 313 ppm |
| Dispersion agent content as used (PVA, ppm) | 125 ppm | 125 ppm |
| Light point defect density per 150 mm diam. wafer (0.12–0.8 micron size) by SFS 6220 | 71 | 424 |
| Haze (ppm, by SFS 6220) | 0.49 | 0.52 |

The slurries used in each of the examples shown above were analyzed for alkali anion and metal content. Levels found were well below the desired total sodium and potassium content upper limit of 1 ppm and below the iron, nickel and copper content limit of 0.1 ppm each.

We claim:

1. A method for final polishing of a silicon wafer comprising (a) placing said wafer in a polishing machine having a polishing pad; and (b) polishing said wafer with said polishing pad in the presence of a slurry comprising water, submicron silica particles at about 0.02 to about 0.5 percent by weight of said slurry, a salt at a concentration of about 100 to about 1000 ppm, an amine compound at a concentration sufficient to effect a slurry pH of about 8 to about 11, and a polyelectrolyte dispersion agent at a concentration of about 20 to about 500 ppm, wherein said slurry has a total sodium and potassium content below about 1 ppm and an iron, nickel, and copper content each below about 0.1 ppm, all ppm being parts per million by weight of said slurry.

2. A method according to claim 1 wherein said salt is comprised of an ammonium cation and an anion selected from the group consisting of carbonate, nitrate, acetate, and citrate.

3. A method according to claim 1 wherein said salt is comprised of an alkyl substituted ammonium cation and an anion selected from the group consisting of carbonate, nitrate, acetate, and citrate.

4. A method according to claim 1 wherein said salt is comprised of an alkaline earth cation and an anion selected from the group consisting of carbonate, nitrate, acetate, and citrate.

5. A method according to claim 1 wherein said amine compound is selected from the group consisting of a primary amine, secondary amine, tertiary amine, quarternary amine, heterocyclic amine, and any mixtures thereof.

6. A method according to claim 1 wherein said amine compound is selected from the group consisting of ethanolamine, aminoethanolamine, guanidine, ethylenediamine, and any mixtures thereof.

7. A method according to claim 1 wherein said polyelectrolyte dispersion agent is polyvinyl alcohol.

8. A method according to claim 1 wherein said polyelectrolyte dispersion agent is polyacrylic acid.

9. A method according to claim 1 wherein said polyelectrolyte dispersion agent is polyacrylamide.

10. A method according to claim 1 wherein said polyelectrolyte dispersion agent is polyethylene oxide.

11. A method according to claim 1 wherein said slurry is prepared from a concentrate having an initial silica particle concentration of about 1 to about 50% by weight of said concentrate, the method further comprising a step prior to step (b) of diluting said concentrate with water to form said slurry.

12. A method according to claim 11 wherein said slurry comprises water, about 0.25% of silica, about 500 ppm ammonium carbonate, about 500 ppm of aminoethanol amine and about 87 ppm polyvinyl alcohol, all by weight of said slurry.

13. A method according to claim 11 wherein said slurry comprises water about 0.45% of silica, about 500 ppm ammonium carbonate, about 500 ppm of aminoethanol amine and about 150 ppm polyvinyl alcohol, all by weight of said slurry.

14. A method according to claim 11 wherein said slurry comprises water, about 0.058% of silica, about 313 ppm ammonium bicarbonate, about 63 ppm of aminoethanol amine and about 125 ppm polyvinyl alcohol, all by weight of said slurry.

15. An aqueous composition suitable for final polishing of silicon wafers comprising: water, submicron silica particles at about 0.02 to about 0.5 percent by weight in said composition, a salt at a concentration of about 100 to about 1000 ppm, an amine compound at a concentration sufficient to effect a composition pH of about 8 to about 11, and a polyelectrolyte dispersion agent at a concentration of about 20 to about 500 ppm, wherein said composition has a total sodium and potassium content below about 1 ppm, and an iron, nickel, and copper content each below about 0.1 ppm, all ppm being parts per million by weight of said composition.

16. A composition according to claim 15 wherein said salt is comprised of an ammonium cation and an anion selected from the group consisting of carbonate, nitrate, acetate, and citrate.

17. A composition according to claim 15 wherein said salt is comprised of an alkyl substituted ammonium cation and an anion selected from the group consisting of carbonate, nitrate, acetate, and citrate.

18. A composition according to claim 15 wherein said salt is comprised of an alkaline earth cation and an anion selected from the group consisting of carbonate, nitrate, acetate, and citrate.

19. A composition according to claim 15 wherein said amine compound is selected from the group consisting of a primary amine, secondary amine, tertiary amine, quarternary amine, heterocyclic amine, and any mixtures thereof.

20. A composition according to claim 15 wherein said amine compound is selected from the group consisting of ethanolamine, aminoethanolamine, guanidine, ethylenediamine, and any mixtures thereof.

21. A composition according to claim 15 wherein said polyelectrolyte dispersion agent is polyvinyl alcohol.

22. A composition according to claim 15 wherein said polyelectrolyte dispersion agent is polyacrylic acid.

23. A composition according to claim 15 wherein said polyelectrolyte dispersion agent is polyacrylamide.

24. A composition according to claim 15 wherein said polyelectrolyte dispersion agent is polyethylene oxide.

25. A composition according to claim 15 comprising: water, about 0.25% of silica, about 500 ppm ammonium carbonate, about 500 ppm aminoethanol amine and about 87 ppm polyvinyl alcohol, all by weight.

26. A composition according to claim 15 comprising: water, about 0.45% of silica, about 500 ppm ammonium carbonate, about 500 ppm aminoethanol amine and about 150 ppm polyvinyl alcohol, all by weight.

27. A composition according to claim 15 comprising: water, about 0.058% of silica, about 313 ppm ammonium bicarbonate, about 63 ppm of aminoethanol amine and about 125 ppm polyvinyl alcohol, all by weight.

* * * * *